US005295378A

United States Patent [19]

Favell

[11] Patent Number: 5,295,378

[45] Date of Patent: Mar. 22, 1994

[54] METHOD FOR MAKING A PRECISELY MACHINED PART

[75] Inventor: Donald Favell, Stamford, Conn.

[73] Assignee: Mark Industries, Torrington, Conn.

[21] Appl. No.: 925,523

[22] Filed: Aug. 5, 1992

[51] Int. Cl.[5] ..... B21D 22/26

[52] U.S. Cl. ..... 72/68; 72/105; 72/332

[58] Field of Search ..... 72/68, 70, 71, 105, 72/327, 334, 332

[56] References Cited

U.S. PATENT DOCUMENTS

| | | | |
|---|---|---|---|
| 496,601 | 5/1893 | Edge . | |
| 523,174 | 7/1894 | Passick . | |
| 1,387,025 | 2/1921 | Hooker . | |
| 1,859,917 | 5/1932 | Engholm et al. . | |
| 2,108,512 | 7/1935 | Reichenbach . | |
| 2,611,475 | 9/1952 | Slater | 72/327 |
| 2,714,412 | 8/1955 | Trondle | 72/71 |
| 2,988,032 | 1/1958 | Voissem . | |
| 3,509,785 | 5/1970 | Fuchs, Jr. . | |
| 3,765,202 | 10/1973 | Bauknecht et al. . | |
| 4,070,895 | 1/1978 | Yamada et al. . | |
| 4,079,614 | 3/1978 | Hall et al. . | |
| 4,339,939 | 7/1982 | Book et al. . | |
| 4,343,119 | 8/1982 | Babnfleth . | |
| 4,343,174 | 8/1982 | Hahn et al. . | |
| 4,389,147 | 6/1983 | Van Alsburg | 72/105 |
| 4,395,811 | 8/1983 | Frye . | |
| 4,397,170 | 8/1983 | Seebach, Jr. | 72/68 |
| 4,407,428 | 10/1983 | Stone . | |
| 4,414,836 | 11/1983 | Saunders . | |
| 4,418,471 | 12/1983 | Torii et al. . | |
| 4,423,616 | 1/1984 | Pease . | |
| 4,453,395 | 6/1984 | Takeda et al. . | |
| 4,631,946 | 12/1986 | Oda . | |
| 5,020,351 | 6/1991 | Castricum . | |
| 5,068,964 | 12/1991 | Yabuno et al. . | |

*Primary Examiner*—Lowell A. Larson

*Attorney, Agent, or Firm*—McCormick, Paulding & Huber

[57] ABSTRACT

A method by which a generally elongate right cylindrically-shaped part is precisely machined and shaped includes the steps of drawing a disc blank into a cup-shaped blank, subsequently drawing the cup-shaped blank a successive number of times to form a generally elongate right cylindrically-shaped part having a finish diameter and a finish length, cutting the generally right cylindrically-shaped part to create a desired edge configuration and to establish a finish diameter for the part, and working the sidewall of the right cylindrically-shaped part to create a desired pattern therein, such that the part produced may be used, for example, as the base shell for the swivel in a lipstick case.

16 Claims, 4 Drawing Sheets

METHOD FOR MAKING A PRECISELY MACHINED PART

This invention relates to a method and related apparatus for forming a desired pattern on a metal piece, and relates more particularly to an improvement in such a method wherein a pattern design is made in the sidewall of a right cylinder part having an open end given a desired edge configuration thereby creating an aesthetically pleasing article of manufacture, for use, such as a base for a lipstick case.

Hitherto, the process by which a design was formed in a substantially right cylindrical part resulted in a product that left unwanted marks including sharp edges on the design which posed potential hazards to individuals during handling. This is especially problematic with designer cosmetic applicator cases wherein metallic parts often have to be formed with aesthetically pleasing pattern designs. In the example of a lipstick case, it is usually the base cap or the swivel part which includes this designer feature. In the past, forming a decorative design in the base cap of a lipstick case was accomplished by a process known as "rubber bulging". In such a process, a plurality of dies are brought into close proximity with the outer wall of the cup-shaped member so as to be circumferentially oriented about it. Thereafter, an expandable member, usually made of rubber or the like, was inserted into the open end of the cylinder and thereafter expanded against its inner surface, thus deforming the wall against the circumferentially disposed die. In so doing, the material of the sidewalls were bulged into the recesses or surface irregularities of the dies which together constituted the pattern to be formed in the cylindrical sidewall. However, it has been found that the plurality of dies which together circumscribe the outer wall of the cylinder to be worked, caused the pattern to be interrupted by marks coinciding with the beginning and the end of each die piece. Furthermore, any shaping of the open end edge of the cylinder had to be made in the article subsequent to the bulging process. This is because it was necessary for the expanded material to act against a uniform surface area in order to distribute the acting force evenly about the cylinder wall. The edge shaping process was usually done by cutting the material by slicing the edge in segments until a desired edge configuration was formed. However, as previously mentioned, this shaping process often resulted in sharp or jagged edges being formed in the article as a result of the noncontinuous cut made in the edge. Both steps, i.e. bulging and cutting, involved in this previously known process inherently required that a multiplicity of steps be employed to effect the final result thereby adding to the time and ultimately the cost of producing such parts.

Accordingly, it is an object of the present invention to provide a method for giving the upstanding sidewall of a right cylindrically shaped part a desired decorative pattern and edge shape that offers a substantial reduction in the time and the cost of producing a designer part, used for example in cosmetic application cases.

Yet a further object of the present invention is to provide a method of the aforementioned type wherein a metal part is manufactured in such a way as to be of a higher quality than those parts made by processes known hitherto wherein a cylindrical part was given a pattern design interrupted by gaps which were the result of processes which employed a plurality of die collectively defining the desired pattern.

It is yet a further object of the present invention to provide a method and related apparatus for shaping a blank along its opened edge such that a continuous cut is made, thereby avoiding the problem known hitherto of jagged or noncontinuous edge in the shape cut into the blank.

SUMMARY OF THE INVENTION

A method of manufacturing a precisely machine shaped part having a finish diameter and a given design comprises the steps of punching a disc blank from a sheet of stock material having given thickness and forming a cup-shaped blank having a first given diameter and a first given length therefrom. Thereafter drawing the cup-shaped blank to establish an intermediate diameter which is greater than the first given diameter but less than the finish diameter and to establish a second given length which is longer than the first given length thereby creating a generally elongate right cylindrically shaped part having a continuous sidewall and an opened edge. The cylindrically shaped part is next drawn to establish the finish diameter while simultaneously creating a preform shoulder in the continuous sidewall. The part is thereafter cut along the preform shoulder such that the material of the sidewall existing between the preform shoulder and the sidewall open leading edge is separated from the remaining portion of the sidewall. The remaining upstanding sidewall of the generally elongate right cylindrically shaped part is then deformed by rolling it between mating rotating members to cause a desired pattern to be deformed into the sidewall.

BRIEF DESCRIPTION OF THE PREFERRED EMBODIMENT

FIGS. 1*a–g* illustrate the blank at various stages of its manufacture and include a flow sheet of the steps of the process associated with each stage.

FIGS. 2*a–2c* illustrate the base shell manufactured by the process of the invention looking at it from various views.

FIG. 3 illustrates in greater detail the arbor and die mechanism associated with the stage illustrated in FIG. 1*e*.

FIGS. 4*a* and 4*b* illustrate the die of FIG. 3 taken along vertical sections oriented ninety degrees from one another.

Figure 7:
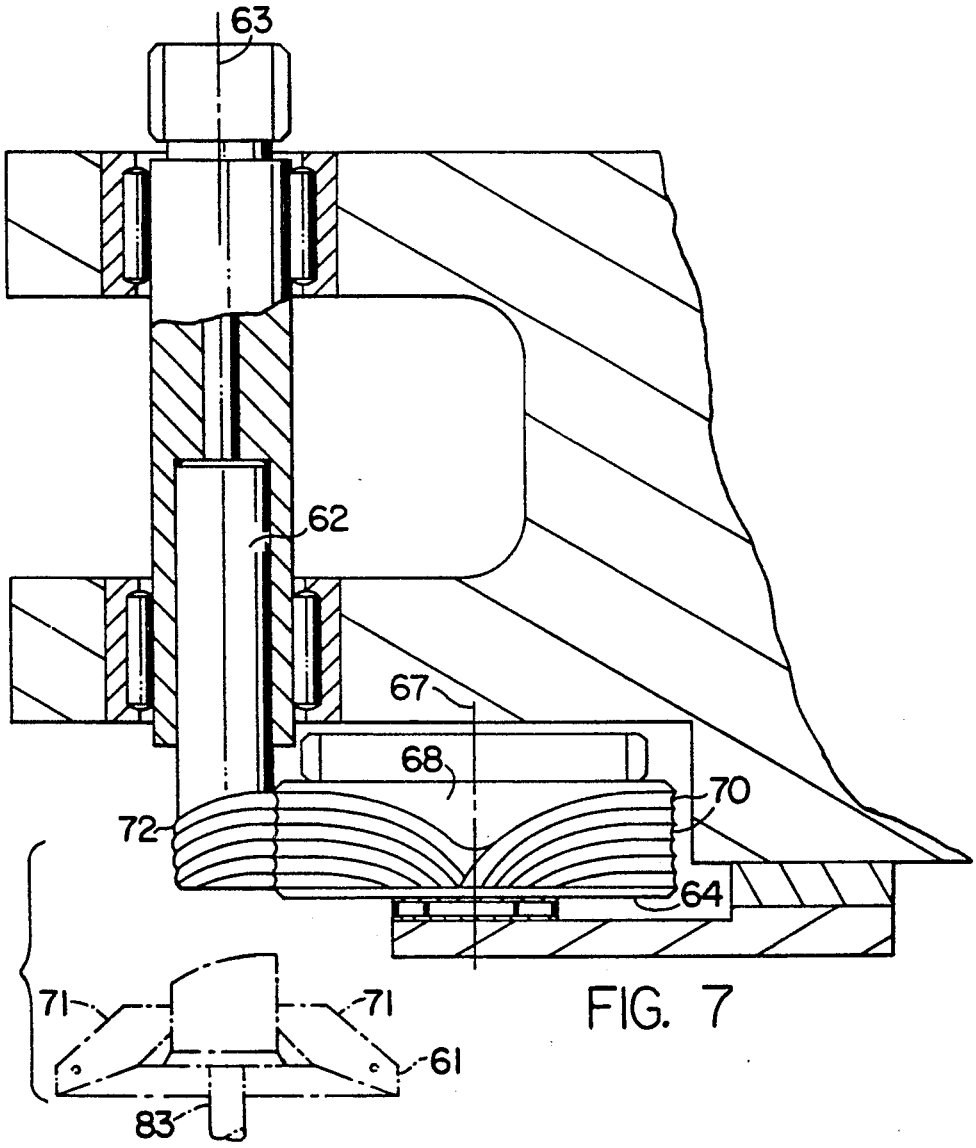
FIG. 7 is a side elevation view of the pattern forming apparatus of the present invention.
Figure 9A:
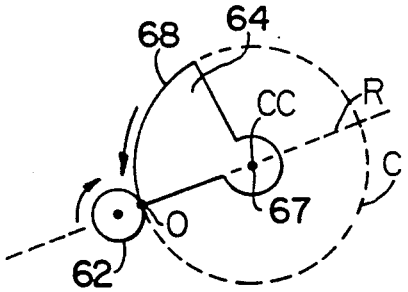
Figure 9B:
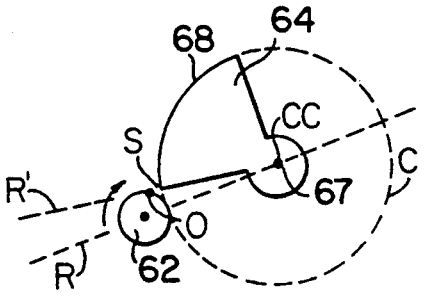

FIGS. 9*a* and 9*b* are a schematic views showing in top plan view angular relationships between the rotating arbor and roll of FIG. 7.

Figure 10:
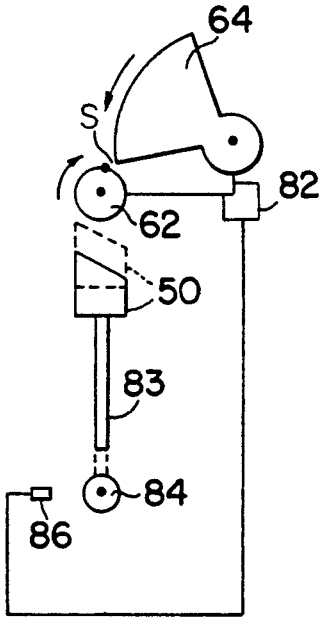

FIG. 10 is a schematic diagram of the timing mechanism used in the apparatus practicing the invention.

DETAILED DESCRIPTION OF THE PREFERRED EMBODIMENT

An embodiment of this invention applied as the base shell of a lipstick case applicator having an ornamental design and a shaped open edge, will be described hereunder in detail with reference to the appended drawings and the associated method. The apparatus in which the method is practiced is one which includes a conventional transfer slide that grips and holds a workpiece and moves it along the apparatus from one station to the next so that given work operations may be performed on the part in a manner which will be hereinafter discussed.

Figure 2A:
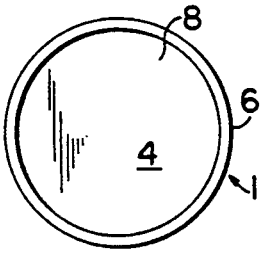
Figure 2B:
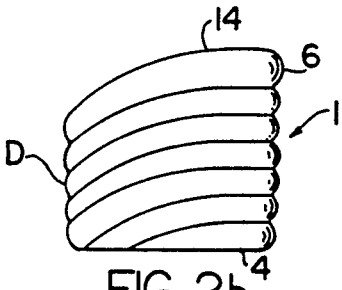
Figure 2C:
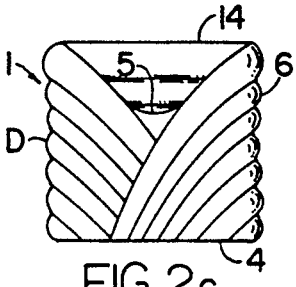

Taking first the article 1 shown in detail in FIGS. 2a–2c produced by the method of invention, it should be seen from FIG. 2a that the article 1 is a generally right angle cylinder having a bottom 4 integrally connected with a cylindrical sidewall 6 which defines an internal confine or cavity 8 opening along a continuous leading edge 14. The edge 14 is given a desired cut-away 5 and the wall 6 is deformed to give it a design D which results in the article 1 having an overall designer look to it.

Figure 1A:
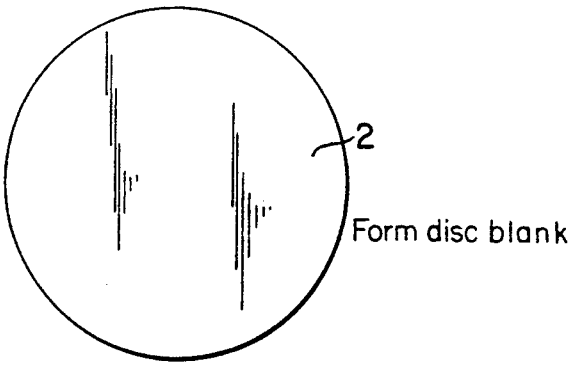
Figure 1B:
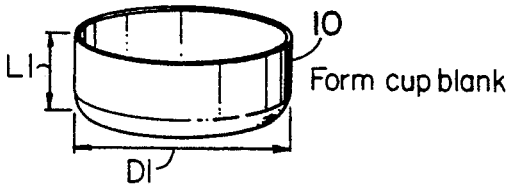
Figure 1C:
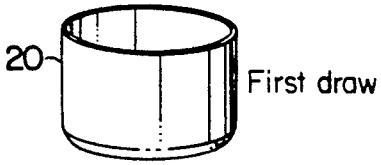
Figure 1D:
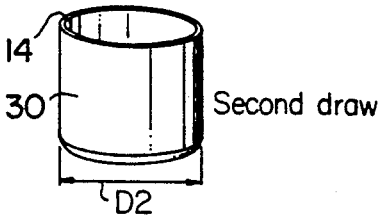
Figure 1E:
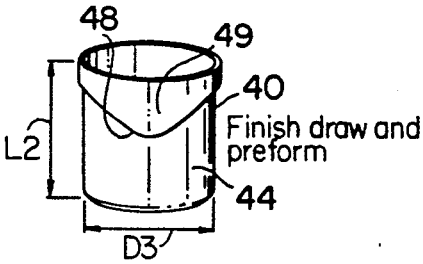
Figure 1F:
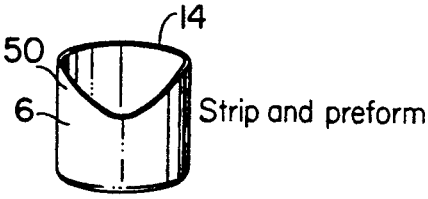
Figure 1G:
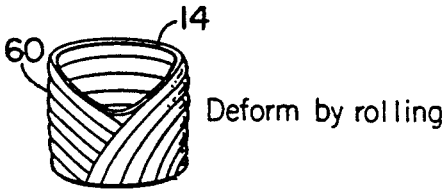

In FIGS. 1a–1g, the method by which the article 1 is made is disclosed. This method includes a blanking step (FIG. 1a), a cupping step (FIG. 1b), a first draw step (FIG. 1c), a second draw step (FIG. 1d), a finish draw and preform step (FIG. 1e), a strip and preform step (FIG. 1f) and a roll deforming step (FIG. 1g). In FIG. 1a, the method is begun by cutting a disc blank 2 from a sheet of stock material in a conventional manner at a blanking station in the apparatus. The stock material from which the blank 2 is cut is highly pure aluminum having an optimum thickness of 0.015 inch. In the step illustrated in FIG. 1b a conventional cup-shaped blank 10 is formed in a manner known in the art from the disc blank 2, which blank 10 having a diameter D1 and a length L1.

In the sequence of steps which follow the formation of the cup-shaped blank 10 as illustrated by FIGS. 1c–e, the diameter D1 of the blank 10 is reduced to a finish diameter D3 which is approximately one-half of the original diameter D1 while its length L2 is increased over the original length L1 thereby transforming the blank into the generally elongate right cylindrically shaped part. To this end, the cup blank 10 undergoes a first draw process (FIG. 1c) which reduces its diameter to an intermediate dimension which is 20 percent of the diameter D1 and which step also causes the blank to become somewhat elongated. The reconstituted blank 20 then undergoes a second draw process (FIG. 1d) which again reduces its diameter to an intermediate diameter D2 which is substantially equal to that of the finish diameter D3. The term "substantially" in this context means that the difference between the diameters D2 and D3 is very close, on the order of about 0.036".

Figure 3:
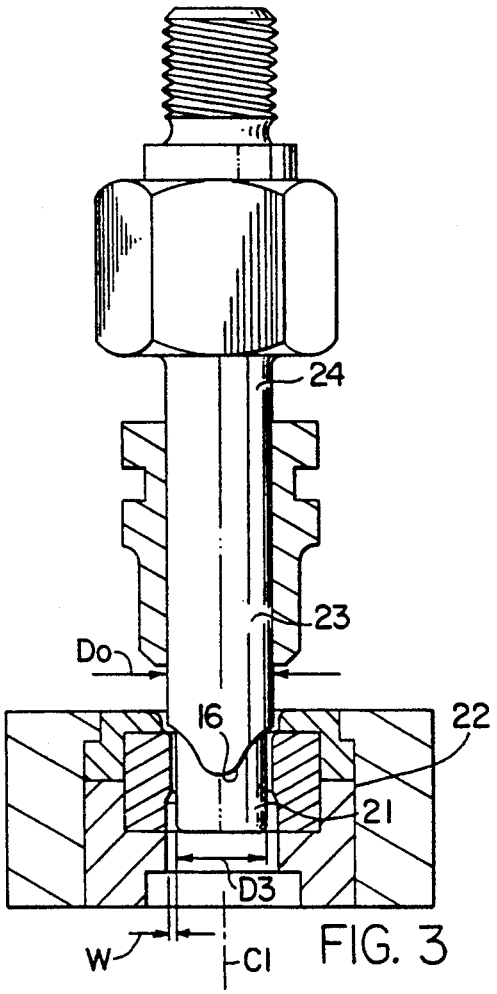
Figure 4A:
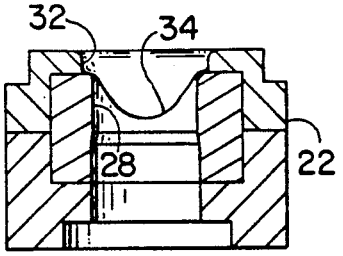
Figure 4B:
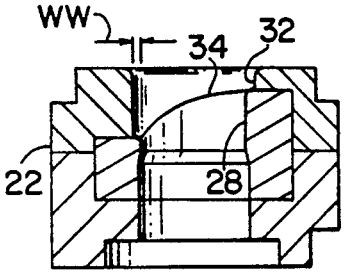

The steps of FIGS. 1e and 1f cause the blank 30 to be given a desired edge shape along its opened end edge 14. For this purpose, a finish draw and preform device as depicted in further detail in FIGS. 3, 4a and 4b is provided as a station in the apparatus. This device includes a reciprocating die 22 and an associated punch 24, each of which elements having correspondingly shaped and sized working coacting surfaces for working the metal of the blank therebetween when the punch strokes through the die. The punch 1 has a depending end which includes first and second portions which differ diametrically by about 0.033". This difference essentially provides a relief for the thickness of the blank that will be worked. The first or lower portion 21 has the finish diameter D3 and the second concentrically disposed upper portion 23 has a larger outer diameter Do, the interface between which two diametrically different portions defining a contour edge 16 having a given width W extending orthogonally to the line of action C1 of the die. The contour edge 16 of the punch 24 cooperates with the die 22 to create a preform or shoulder 48 in the blank 30 having the shape of the edge 16. For this, the die 22 has an inner surface structure which is adapted to mate with the contour edge 16. This surface structure is defined by a first neck portion 28 having a diameter which is somewhat larger, for example on the order of about 0.050", than the finished diameter D3 and is defined by a second wider neck portion 32, which is concentric with the first neck portion 28 and is connected to it through the intermediary of a continuous shoulder 34. The shoulder 34 is correspondingly shaped to mate with the contoured edge 16. As such, it extends generally perpendicularly to the line of action C1 of the punch and has a width WW equalling about 0.0125". Thus, the finish draw and preform step of FIG. 1e causes the blank 30 to be worked between the depending end portion 21 of the punch 24 and the die shoulder 34 to give the resultant blank 40 a lower portion 44 having the finish diameter D3 and an upper portion 49 of a diameter which is sizewise diametrically larger than the lower portion 44 by about twice the dimension W.

Figure 6:
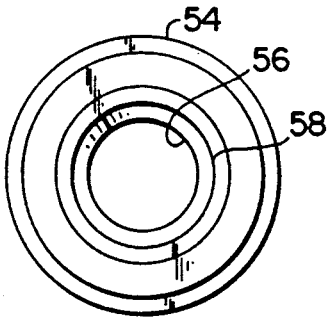
FIG. 6 is a top plan view of the die shown in FIG. 5.
Figure 5:
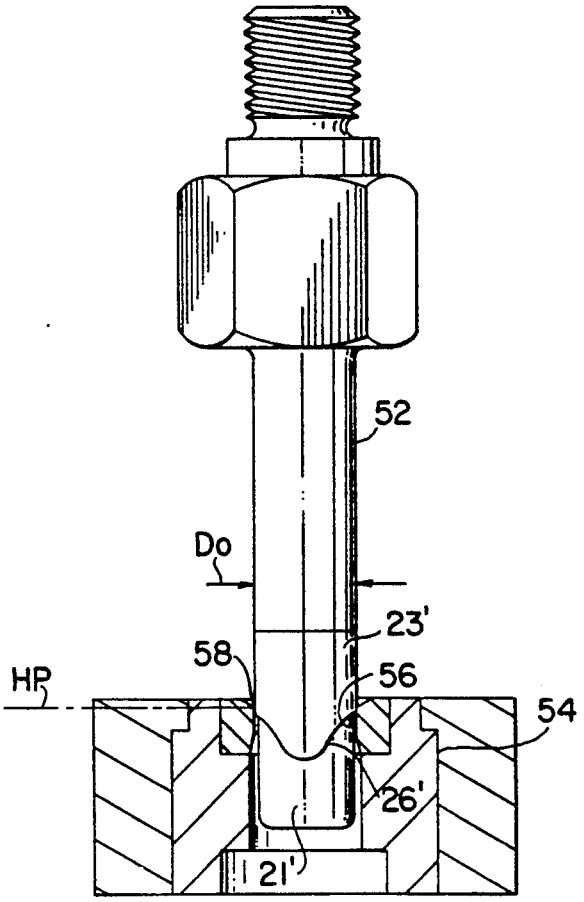
FIG. 5 illustrates a die and arbor apparatus associated with the stage illustrated in FIG. 1*f*.

In the strip and preform step of FIG. 1f, the blank 40 is cut to eliminate the upper portion 49 existing between the preform or shoulder 48 and the leading edge 14. For this purpose, the die and punch assembly of FIG. 5 is provided and includes another reciprocating punch 52 having a contour edge 16, identical to that of the contour edge 26 formed on the punch 24. The identically shaped and sized contour edge 26' is important in that it seats within the similarly sized and shaped shoulder 48 formed in the blank 40 so as to insure automatic and accurate registration with the punch 52 once the blank is advanced from the finish draw and preform step of FIG. 1e to the strip and preform step of FIG. 1f. As shown in FIG. 6, the die 54 of this assembly is different from the die 22 in that it has a circular opening 56, the diameter of which is only slightly larger, on the order for example of 0.0005", than the outer diameter Do of the upper portion 23' of the punch 52 so to cause the upper portion 49 to be severed along the shoulder 48 of the blank 40. That is, the opening 56 at its upper face is defined by a leading cutting edge 58 which extends annularly and in a common horizontal plane HP. With the continued downward movement of the punch 52, the laterally outwardly extending preform shoulder 48 of the blank 40 is caused to be sheared by the edge 58 thereby completely separating the upper portion 49 of the blank 40 with a single downward stroke of the punch 52.

The final step (FIG. 1g) of the process involves deforming the no cut blank 50 by rolling its sidewall circumferentially between two rotating means mounted to the apparatus in a manner shown in FIG. 7. The rotating means includes an arbor 62 rotated about a central rotational axis 63, a roll 64 juxtaposed relative to the arbor and rotatable about an associated central axis 67, and means for loading and stripping the blank on and off the arbor. The arbor 62 and the roll 64 are positively intermittently drivingly coupled to one another by an appropriate gearing system, such that for every one rotation of the roll 64, the arbor 62 rotates a multiple of times, which in the case of the preferred embodiment, is about four turns for every revolution of the roll. The blank 50 is transported along the apparatus by a conventional holder 61 having opposed teeth 71,71 pivotally mounted to the transfer slide of the apparatus as shown in the phantom line portrayal in FIG. 7. The teeth are spring loaded to remain in either the illustrated closed or an otherwise open position. Thus, the teeth release the blank 50 when it is driven upward by an appropriate mechanism which loads the blank onto the depending end of the arbor 62 as will be discussed later in greater detail.

Figure 8:
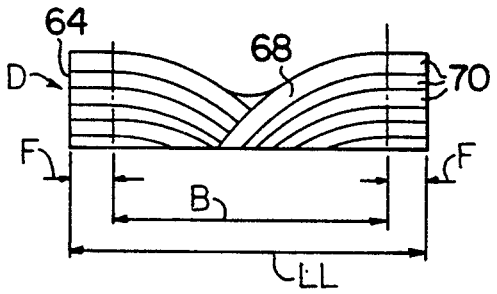
FIG. 8 is a front elevation view of the roll segment tool of FIG. 7.

Referring now to FIGS. 8–10, it should be seen that the roll 64 is actually a segment of an imaginary circle C having a center of curvature CC coincident with the rotational axis 67 and the center of the theoretical circle C that would otherwise circumscribe it. The roll 64 has an external face 68 on which is disposed a desired pattern to be transferred to the sidewall 6 of the blank 50. The pattern D on the part 1 is formed by the cooperative action of mating surfaces on each of the roll segment 64 and the arbor 62. As best seen in FIG. 8, the roll 64 has an outer face 68 on which are disposed a plurality of continuous grooves 70,70 oriented side-by-side with one another. The arbor 62 has disposed circumferentially around it a plurality of rounded ridges 72,72 which mate within the grooves 70,70 formed in the roll 64. Additionally, the arbor has a diameter which is sized diametrically slightly smaller than the inner diameter of the blank 50 so that the blank may be slidingly received over it. In the illustrated embodiment, the design D is nonrepeating and therefore it is necessary to insure that the grooves 72,72 and the ridges 70,70 disposed respectively on the roll and the arbor always mate at corresponding points on their respective designs. This is accomplished by the gearing which positively rotatably couples the arbor 62 with the roll 64, but this angular relationship may in an alternative embodiment, be achieved by driving the elements using electronic controls.

As illustrated in FIG. 9*a*, the angular relationship between the arbor 62 and the roll 64 is such that the leading edge of the face 68 always passes through an initial reference plane R simultaneously with a designated origin point 0 on the arbor 62. The design D on the face 68 of the roll as shown in FIG. 8 is non-repeating, but a stretch of the pattern which extends in parallel straight lines is disposed on the face 68 such that it defines leading and trailing end portions F,F. The length LL of the face 68 of the roller segment 64 exceeds the circumference of the arbor 62 by the length of one of the sections F. That is, the dimension B as shown in FIG. 8 represents the circumference of the arbor die 64 which means that there is an overtravel of the design imparted to the blank 50 by the roll 64 by an amount equal to the length of one section F. This is important in that any gap or interruption which would otherwise possibly exist as a result of the arbor and the roll not beginning and ending at the same point on the blank, is avoided by the overtravel of the two straight line portions F,F.

As shown schematically in FIG. 10, the apparatus includes a mechanism 80 for loading the blank 50 onto the arbor 62 in timing with the starting and stopping of the roller segment 64 and the arbor 62. This mechanism includes an elevator cam 84, a driving member 83, a sensor 86 and a drive motor 82 which is slaved to the movement of the cam member 84 which is responsible for driving the blank 50 upward over the arbor 62 once the slide 61 arrive at the roll deforming stations. At this point, the roll segment 64 and the arbor 62 are stopped in a home position illustrated in FIG. 9*b*. In this position, the relative angular relationship between the roll segment 64 and the arbor 62 is such that the leading edge of the roll segment lies in a plane R′ which is slightly retarded from the engagement plane R so as to provide a clearance S for the blank 50 to be received over and stripped from the arbor 62 without interference from the roll segment 64. The orientation of the arbor 62 at the home position is selected such that when the blank is loaded onto it, the design D on the arbor will correspond positionally to where it will be worked onto the sidewall of the blank 50.

The movement of the holder 61 is coordinated with the rotation of the cam 84 such that as the slide arrives at the rolling station, the cam 84 begins to drive the blank 50 upwards. The sensor 86 senses the top-dead-center position of the cam and causes, through appropriate controls, the motor to rotate the roll segment 64 and the arbor 62 in a manner previously discussed and to thereafter stop thus in the home position illustrated in FIG. 9*b*. The finished blank 60 is then stripped from the arbor in a conventional manner and the process is repeated.

By the foregoing, the preferred embodiment of the invention has been described by way of illustration rather than limitation, however, numerous modifications and substitutions may be had without departing from the spirit of the invention. For example, with regard to FIG. 10, it is disclosed that the drive used to rotate the arbor 42 and the roll segment 46 is an electronically controlled drive motor. However, such electronically controlled drive may alternatively be replaced by a mechanically operated means, such as an intermittently driven geneva gear box. Accordingly, the application has been described by way of illustration rather than limitation.

I claim:

1. A method of manufacturing a precisely machine shaped part comprising the steps of:

forming a circular blank from a sheet of stock material having a given thickness;

forming a cup-shaped blank having a first given diameter and a first given length;

drawing said cup-shaped blank at least one time to form a generally right cylindrical part having a continuous sidewall and an open end defined by a leading edge such that said generally right cylindrical part has a finish diameter;

cutting a portion of the generally right cylindrical part below the leading open edge and above the base to create a desired edge shape configuration therein;

deforming the sidewall of said part by rotating it between juxtaposed tools, each of which rotating tools having corresponding mating surfaces which deform the sidewall of the part such that a design pattern is made therein;

said cup-shaped blank undergoing successive drawing steps to transform said cup-shaped blank into said generally elongate right cylindrical part with the last of said drawing steps including the simultaneous cutting of said edge shape configuration below the opened edge of said generally elongate right cylindrical shaped part; and wherein said step of cutting said edge shape configuration is preceded by a precut drawing step wherein the finish diameter is established for said generally elongate right cylindrically-shaped part and a preform shoulder is simultaneously formed in the sidewall of said generally cylindrically-shaped part simultaneously with establishing of the finish diameter.

2. A method as defined in claim 1 further characterized in that cutting of said leading open edge of said generally cylindrically-shaped part is accomplished by drawing said preform shoulder against a circular die having a cutting opening which is substantially equal in diameter to the finished diameter of said blank.

3. A method as defined in claim 2 further characterized in that said preform shoulder formed in the sidewall of said generally right cylindrically-shaped part is accomplished by drawing said blank with a punch having a first lower portion of a first diameter and a second upper portion of a second diameter larger than said diameter of said first lower portion, the interface between said first and second portions generally defining a contour edge the width of which contour edge being substantially equal to that of the preform shoulder formed in said blank.

4. A method as defined in claim 3 further characterized by using in each of said final draw step and said precut draw step an identical punch having identical contoured edges for insuring registration with the blank when forming said preform shoulder in the continuous sidewall of said generally right cylindrical-shaped part.

5. A method as defined in claim 4 further characterized in that said precut draw step includes providing a shoulder die having a first neck portion associated with said second upper portion of said punch and a second neck portion associated with the first upper portion of said punch, the first neck portion having a diameter slightly larger than that said second neck portion the interface between said first and second neck portions defining the width of a die preform shoulder.

6. A method as defined in claim 5 further characterized in that said step of deforming said sidewall of said generally right angular cylindrical-shaped part includes the step of providing said two rotating tools and includes providing a rotating arbor and a rotating roll segment having opposed faces positively coupled together with one another for unitary rotational intermittent relative movement;

maintaining each of said rotatable arbor and roll segment in a home position relative to one another prior to said part being loaded onto said arbor; and driving said generally elongate right cylindrically-shaped part from a transfer slide and onto said arbor at a given orientation and thereafter rotating said roll segment one full revolution from said home position while simultaneously rotating said arbor a multiplicity of revolutions for the one full revolution taken by the roll segment.

7. A method as defined in claim 6 further characterized by positioning said roll segment relative to said arbor when said arbor and said roll segment are in said home position such that said roll segment is slightly retarded from the point where said segment first engages the arbor, said slight retarding of said roll segment at said home position being slightly larger than the thickness of said sidewall of said generally right angular cylindrically-shaped part.

8. A method as defined in claim 7 further characterized by said pattern design to be imparted to said generally right angular cylindrically-shaped part has a non-repeating pattern and circumscribing it about said arbor; and wherein said pattern extends along an external face on said roll segment a length which slightly exceeds the circumference of said arbor.

9. A method as defined in claim 8 further characterized in that said arbor and said roll segment are drivingly coupled with one another such that initial engagement between said roll segment and said arbor always occurs at the leading edge of said roll segment and at a given origin on the arbor such that for each revolution of said roll segment said arbor rotates a multiple of that revolution with both the arbor and the roll segment simultaneously to a given home position.

10. A method as defined in claim 9 further characterized in that said pattern design extending along the face of said roll segment is defined by a plurality of lines defined by a plurality of ridges which are oriented side-by-side with one another and which ridges are non-repeating repeating in pattern except for a stretch wherein the lines extend straight parallel to one another and to the direction about which the roll is rotated; and providing said pattern on said roll segment such that the leading and trailing end portions of said pattern formed on said roll segment are defined by the stretch of straight lines of said pattern.

11. A method as defined in claim 10 further characterized by providing said home position for said arbor and said roll segment as the loading and unload condition for the part to be worked.

12. A method as defined in claim 11 further characterized by providing said roll segment with an arcuate length which is greater than the circumference of said arbor such that said sidewall of said generally right angle cylindrically-shaped part is first deformed by the stretch of the straight lines of the design and is thereafter worked by the design disposed between said straight line stretches and thereafter is additionally worked an additional length in excess of said arbor circumference along said straight line stretch to eliminate any start and finish marks on the part.

13. A method ad defined in claim 12 further characterized by intermittently driving each of said rotating arbor and said roll segment using an electric drive motor to precisely rotate the arbor and the roll segment and return them simultaneously to said home position in precise orientation with respect to said respective given home positions for a given single rotation of said roll segment; and slaving said drive motor to a mechanical means for loading the machine shaped onto said arbor such that the arbor and roll rotate only after the blank is seated over the arbor.

14. A method as defined in claim 13 further characterized by providing said sheet of stock material from which said cup-shaped blank is formed from a highly pure aluminum having a thickness of about 0.015 inch.

15. A method of manufacturing a precisely machine shaped part having a finish diameter and a given design comprising the steps of:

punching a disc blank from a sheet of stock material having a given thickness;

forming a cup-shaped blank having a first given diameter and a first given length;

drawing said cup-shaped blank to establish an intermediate diameter which is less than said first given diameter but greater than said finished diameter and to establish a second given length which is longer than said first given length thereby creating a generally elongate right cylindrically shaped part having a continuous sidewall and opened edge;

drawing said generally elongate right cylindrically shaped part to establish said finish diameter while simultaneously creating a preform shoulder in the continuous sidewall of the generally elongate right cylindrically shaped part;

drawing said generally elongate right cylindrically shaped part to cut the preform shoulder and the material of the sidewall existing between the preform shoulder and said sidewall open leading edge from the remaining portion of said sidewall; and working the remaining upstanding sidewall of said generally elongate right cylindrically-shaped part by rolling the upstanding sidewall between mating rotating members to cause a desired pattern to be deformed into the sidewall.

16. A method of forming a generally elongate right cylindrical-shaped part comprising the steps of:

forming a generally elongate right cylindrically-shaped part from a blank defined by a sidewall of a given thickness and a base portion integrally connected with one another at one end of said part;

establishing a reference point on said sidewall corresponding to the point thereon where the pattern design is to be first imparted to the sidewall;

providing a rotating arbor and a rotating roll segment defined by a leading edge and a trailing edge and positively coupling one with the other for unitary rotational intermittent movement;

orienting the outer surface of said arbor and the outer surface of said roll segment relative to other another when in a stopped condition such that the arbor outer surface is spaced from the leading edge of the roll segment by at least about the thickness of said sidewall;

providing said outer surface of said arbor and said outer surface of said roll segment as complementary surfaces defining a pattern to be imparted to the sidewall of said part;

deforming the sidewall of said part by causing the blank form of the part to be placed over said arbor when said arbor and the roll segment are in the stopped condition and thereafter causing the arbor and the roll segment to be rotated relative to one another to cause the pattern to be imparted from the complementary outer surfaces of arbor and the roll segment and into the material;

circumscribing said pattern totally about said outer surface of said arbor and forming said pattern along the outer surface of said roll segment such that it extends along a length as defined between said leading and trailing edges and defining said length such that it slightly exceeds the circumference of said arbor;

establishing said stopped condition orientation between the roll segment and the arbor such that for a given revolution of said roll segment, said arbor rotates a multiply of that revolution with both the arbor and the roll segment returning simultaneously to said established reference orientation.

* * * * *